US006774609B2

(12) United States Patent
Heftman

(10) Patent No.: US 6,774,609 B2
(45) Date of Patent: Aug. 10, 2004

(54) MULTI-VOLTAGE INVERTER CIRCUITS FOR CHARGING A CAPACITIVE LOAD

(75) Inventor: George Heftman, Bishops Stortford (GB)

(73) Assignee: Nicotech Limited, Kings Langley (GB)

( * ) Notice: Subject to any disclaimer, the term of this patent is extended or adjusted under 35 U.S.C. 154(b) by 0 days.

(21) Appl. No.: 10/192,778

(22) Filed: Jul. 9, 2002

(65) Prior Publication Data

US 2004/0008526 A1 Jan. 15, 2004

(51) Int. Cl.[7] ..... G05F 1/613
(52) U.S. Cl. ..... 323/222; 323/285
(58) Field of Search ..... 323/222, 282, 323/284, 285; 363/97, 124, 131

(56) References Cited

U.S. PATENT DOCUMENTS 6,366,058 B1 * 4/2002 Honsberg ..... 323/222

FOREIGN PATENT DOCUMENTS

GB 2 318 655 4/1998 ..... H02M/3/24
JP 60-82196 4/1985 ..... H05B/41/34

* cited by examiner

*Primary Examiner*—Jeffrey Sterrett
(74) *Attorney, Agent, or Firm*—Davis & Bujold PLLC

(57) ABSTRACT

An inverter circuit charges a capacitive load 4 incrementally by repetitive fly-back in an inductor 8 connected in series with an FET 9 across DC input terminals 2,3. A transistor 14, turned ON in response to current build-up in the inductor 8 during each charging cycle, switches FET 9 OFF to initiate fly-back, and feedback from the fly-back acts via a resistor 16 to hold transistor 14 ON and FET 9 OFF through to the cycle end. Adding resistors 21,22 in series with the load 4 across the input terminals 2,3, derives a voltage which, like that via the feedback resistor 16, is dependent on the input voltage. The derived voltage acts via a zener diode 23 to counteract the feedback, holding transistor 14 OFF and interrupting further charging until the load 4 is discharged into a xenon flash-tube 5. By making the values of resistors 16 and 21 equal, the load 4 charges to a voltage independent of input-voltage variation; with them unequal, a deliberate variation of output voltage with input can be obtained.

15 Claims, 1 Drawing Sheet

MULTI-VOLTAGE INVERTER CIRCUITS FOR CHARGING A CAPACITIVE LOAD

FIELD OF THE INVENTION

This invention relates to inverter circuits.

BACKGROUND OF THE INVENTION

Inverter circuits for converting DC input voltage to higher-voltage output to charge a capacitive load, are known and find application, for example, in the powering of xenon flash-discharge tubes. Xenon flash-discharge tubes are used to produce repetitive short-duration flashes of light for beacon purposes in giving a visual signal or warning, and in this respect may be used in burglar-and fire-alarm systems and on police, ambulance, fire-service and other vehicles.

In many applications and potential applications of xenon tubes in this way, the voltage of the available DC power supply may have any of a number of nominal values, and in any particular case may be liable to vary significantly from that nominal value. For example, the beacon may be for use on a vehicle having a 12-volt, 24-volt or other battery, and the battery-voltage may vary significantly from the nominal value according to the state of charge of the battery and whether the vehicle's engine is running. It is not in general simple to provide for satisfactory operation of xenon tubes in these circumstances using known inverter circuits, since the output of the inverter circuit is too dependent on the power-supply voltage. Moreover, the majority of xenon tubes operate satisfactorily only within a narrow range of applied voltage.

SUMMARY OF THE INVENTION

It is one of the objects of the present invention to provide a form of inverter circuit that may be used in the above circumstances to power a xenon tube satisfactorily throughout a wide range of DC supply voltages.

According to the present invention there is provided an inverter circuit for charging a capacitive load, in which switching means is connected in series with inductance across DC-input terminals of the circuit to switch cyclically from an ON state to an OFF state for charging the capacitive load incrementally from fly-back in the inductance, the switching means being held in its OFF state during each cycle of operation by feedback of the fly-back voltage, wherein the circuit includes means for deriving a voltage that is dependent on the voltage across the capacitive load and for applying the derived voltage to counteract the feedback such as thereby to interrupt the cyclic operation of the circuit.

Switching of the switching means between its ON and OFF states may be regulated by a transistor device such that the switching means has its ON state while the transistor device is OFF and its OFF state while the transistor device is ON. The transistor device may be turned ON so as to initiate the fly-back of the cycle, in response to build up of current in the inductance, and it may be maintained ON during the fly-back by the feedback. In these circumstances, the derived voltage dependent upon the voltage across the capacitive load, may be applied to the transistor device to counteract the feedback by holding the transistor device OFF during the fly-back.

The voltage to which the capacitive load is charged may be limited by the counteracting effect of the derived voltage to a level that is substantially independent of the voltage of the DC-supply connected to the input terminals. This can be achieved with the inverter circuit of the invention simply by choice of the relative values of two resistors, one in the feedback path and the other used for derivation of the voltage used in counteraction of the feedback. Moreover, by adjustment of the relative values of these resistors, it is possible even to achieve limitation of the voltage to which the capacitive load is charged, to a level that is lower the higher the voltage of the DC-supply connected to the input terminals.

BRIEF DESCRIPTION OF THE DRAWINGS

A xenon flashing-beacon unit incorporating an inverter circuit according to the present invention, will now be described, by way of example, with reference to the accompanying drawings, in which.

DETAILED DESCRIPTION OF THE INVENTION

Figure 1:
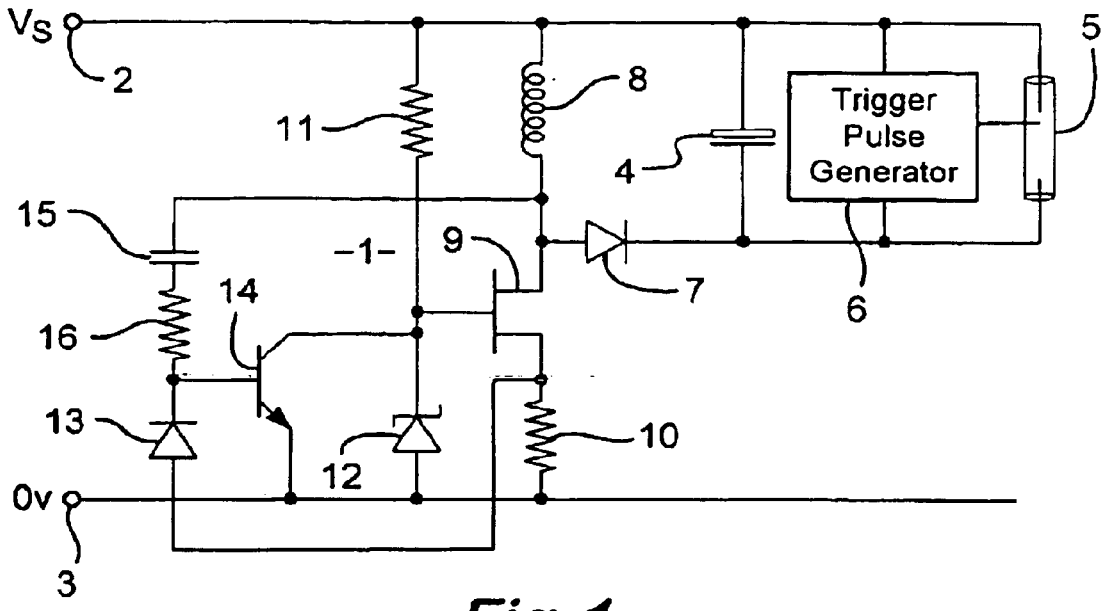
Fig. 1 Prior Art
FIG. 1 shows a xenon flashing-beacon unit including a basic form of inverter circuit.

Referring to FIG. 1, the xenon flashing-beacon unit includes an inverter circuit 1 that is powered by an external DC-supply source (not shown) connected to 'positive' and 'negative' input terminals 2 and 3, for charging a capacitor 4 to a higher voltage incrementally. The voltage across the capacitor 4 is applied between the anode and cathode of a xenon tube 5 of the unit, and a trigger-pulse generator 6 within the unit supplies a high-voltage pulse at regular intervals between the trigger-electrode and cathode of the tube 5. The trigger-pulse initiates discharge within the tube 5 of the accumulated charge of the capacitor 4, and the process of charging the capacitor 4 incrementally during successive cycles of operation of the inverter circuit 1, and then discharging it through the tube 5, recurs to cause the emission of a regular succession of bright flashes of light from the tube 5.

The capacitor 4 is charged via a diode 7 from fly-back voltage that occurs across an inductor 8 during each cycle of operation of the inverter circuit 1. Each cycle is initiated by supply of current to the inductor 8 from the DC-supply source via a field-effect transistor 9 and resistor 10 in series. The gate of the transistor 9 is connected to the junction of a resistor 11 and zener diode 12 that are connected across the terminals 2 and 3 to bias the transistor 9 ON. As current builds up in the inductor 8 through the transistor 9, the rise in voltage across the resistor 10 brings both a diode 13 connected to the base of a bi-polar transistor 14, and the transistor 14 itself, into conduction.

The collector of the transistor 14 is connected to the gate of the transistor 9 at the junction of the resistor 11 and diode 12 so that conduction of the transistor 14 turns the transistor 9 OFF. The consequent fly-back voltage across the inductor 8 causes the diode 7 to conduct in transferring energy built up in the inductor 8 to increment charge of the capacitor 4. During the transfer, the transistor 14 is held ON, and the transistor 9 consequently OFF, by current derived from the fly-back voltage supplied as feedback to the base of the transistor 14 via a capacitor 15 and resistor 16 in series. Once transfer has been completed the transistor 14 turns OFF and the transistor 9 conducts again to initiate a new cycle of operation of the inverter circuit 1.

The inverter circuit 1 is of simple and economic form and operates effectively, but has the disadvantage that the charge accumulated on the capacitor 4 in the intervals between its discharge into the xenon tube 5 is dependent on the voltage $V_s$ applied across the terminals 2 and 3. The majority of xenon tubes operate satisfactorily only within a narrow range of applied voltage, but in many applications of such tubes the nominal voltage of the available power-supply source is not within this range and there may in any case be substantial variation from the nominal value during use.

In accordance with the present invention the disadvantage of supply-voltage dependence is overcome with very simple modification of the circuit of FIG. 1. This modification will now be described with reference to FIG. 2 in which components common to FIG. 1 have the same references as used in FIG. 1.

Figure 2:
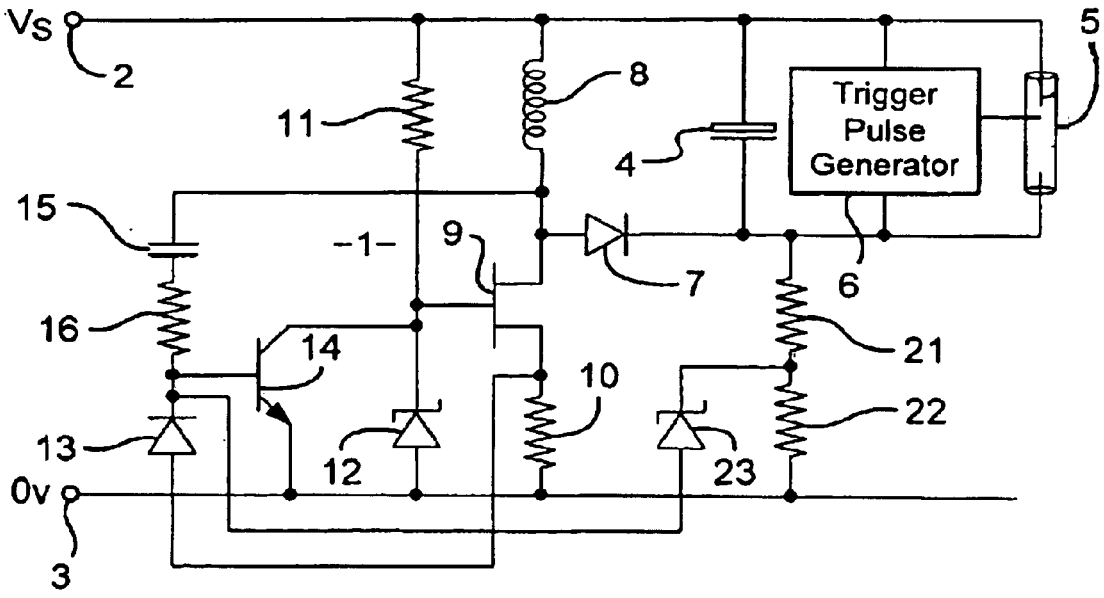
FIG. 2 shows the xenon flashing-beacon unit of FIG. 1 modified to incorporate an inverter circuit according to the present invention.

Referring to FIG. 2, the modification involves simply the addition of resistors 21 and 22 connected in series between the negative terminal 3 and the junction of the diode 7 with the capacitor 4, together with a zener diode 23 connected between the junction of the two resistors 21 and 22 and the base of the transistor 14. The consequence of the modification is that the transistor 14 is held OFF, so as thereby to interrupt cyclic operation of the inverter circuit 1, and therefore further incremental charging of the capacitor 4, once a limiting voltage level across the capacitor 4 has been reached. This limiting voltage level, which is dependent on the values of the resistors 21 and 22 and the characteristics of the diode 23, is independent of the supply voltage $V_s$ applied across the terminals 2 and 3.

The voltage applied across the resistors 21 and 22, since they are connected in series with the capacitor 4 across the terminals 2 and 3, is the sum of the supply voltage $V_s$ and the voltage across the capacitor 4 due to its charge. Accordingly, as charging of the capacitor 4 proceeds during successive cycles of the inverter circuit 1, current flow in the resistors 21 and 22 increases and eventually reaches a magnitude sufficient to act via the diode 23 to hold the transistor 14 OFF during fly-back of the inductor 8. This condition exists when the voltage across the capacitor 4 has attained a limiting level that is independent of the supply voltage $V_s$, provided that resistors 21 and 16 are of the same value as one another.

The current flowing in the resistor 16 on fly-back is dependent on the supply voltage $V_s$, so by giving the resistor 21 the same value as that of the resistor 16, a condition is reached in which the feedback voltage across the resistor 16 is counteracted by the voltage across the resistor 21 to hold the transistor 14 OFF. This occurs when:

$$V_o \cdot R_{22}/(R_{21}+R_{22}) > V_z$$

where $V_o$ is the output voltage, $R_{21}$ and $R_{22}$ are the values of resistors 21 and 22 and $V_z$ is the zener voltage of diode 23.

The above condition prevails so as to interrupt the cyclic operation of the inverter circuit 1, and therefore further incremental charging of the capacitor 4 beyond a limiting level, until the capacitor 4 is next discharged into the xenon tube 5. Cyclic operation of the inverter circuit 1 is then resumed to re-charge the capacitor 4 incrementally until the limiting voltage level is reached, whereupon operation of the circuit 1 is interrupted again until there has been discharge of the capacitor 4 into the tube 5.

Variation of output voltage with input voltage can be deliberately introduced by adjusting the ratio of the values of resistors 21 and 16. For example, if the resistance of resistor 16 is increased above the resistance of resistor 21 then the output voltage will fall with increasing input voltage. This adjustment can be used to control the flash rate at higher input voltages in cases where the trigger circuit rate is voltage dependent.

What is claimed is:

1. An inverter circuit for charging a capacitive load, in which switching means is connected in series with inductance across DC-input terminals of the circuit to switch the switching means cyclically from an ON state to an OFF state for charging the capacitive load incrementally from fly-back in the inductance, and the inverter circuit includes feedback means coupled to the inductance for deriving a feedback voltage from the fly-back in the inductance, and further means operative in response to the feedback voltage for holding the switching means in the OFF state during fly-back of each cycle of operation, wherein the circuit also includes means for deriving a control voltage that is dependent on the voltage across the capacitive load, and circuit means for applying the derived control voltage to the further means for interrupting the cyclic operation of the circuit, the circuit means applying the control voltage to the further means to counteract response of the further means to the feedback voltage.

2. The inverter circuit according to claim 1 wherein the further means includes a transistor device for regulating the switching of the switching means between the ON and OFF states, the switching means having the ON state while the transistor device is OFF and the OFF state while the transistor device is ON, and wherein the feedback means applies the feedback voltage to the transistor device for holding the transistor device ON during fly-back of the cycle.

3. The inverter circuit according to claim 2 including resistance connected in series with the switching means and the inductance, a diode, and means for applying the voltage from the resistance to the transistor device via the diode to turn the transistor device ON as to turn the switching device OFF for initiating the fly-back in the inductance.

4. The inverter circuit according to claim 2 wherein said feedback voltage is applied to the transistor device for maintaining it ON during the fly-back of each cycle, and wherein the control voltage is applied to the transistor device to counteract the feedback voltage by holding the transistor device OFF during the fly-back.

5. The inverter circuit according to claim 2 wherein the switching means is a field-effect transistor, and wherein the channel of the field-effect transistor is connected in series with the inductance.

6. The inverter circuit according to claim 2 wherein said means for deriving a voltage comprises two resistors connected together to form a series-resistance chain with one another, electrical connection means connecting the series-resistance chain in series with the capacitive load across the DC-input terminals, said resistance chain having a connection node intermediate the two resistors, and a zener diode connected between the connection node and the transistor device, the zener diode responding to the condition in which voltage across one of the two resistors exceeds a threshold dependent on the zener breakdown voltage of the zener diode, to hold the transistor device OFF.

7. The inverter circuit according to claim 6 wherein the application of the feedback voltage to the transistor device is via resistance of substantially equal value to that of one of the two resistors.

8. The inverter circuit according to claim 1 wherein the voltage to which the capacitive load is charged is limited by the counteracting effect of the control voltage to a level substantially independent of the voltage of the DC-supply connected to the input terminals.

9. The inverter circuit according to claim 1 wherein the voltage to which the capacitive load is charged is limited by the counteracting effect of the control voltage to a level that is lower than the higher voltage of the DC-supply connected to the input terminals.

10. The inverter circuit according to claim 1 in combination with a trigger circuit and a xenon discharge tube, wherein the voltage to which the capacitive load is charged by the inverter circuit is limited by the counteracting effect of the control voltage to one of (a) a level substantially independent of the voltage of the DC-supply connected to the input terminals, and (b) a level lower than the higher voltage, and wherein the trigger circuit is operative to discharge the capacitive load recurrently into the xenon discharge tube.

11. An inverter circuit for charging a capacitive load, comprising: DC-input terminals; an inductance; switching means connected in series with the inductance across the DC-input terminals; circuit means for switching the switching means cyclically from an ON state to an OFF state for charging the capacitive load incrementally from fly-back in the inductance, the circuit means comprising feedback means for deriving a feedback voltage from the fly-back in the inductance, and further means operative in response to the feedback voltage for holding the switching means in the OFF state during the fly-back in each cycle of operation; means for deriving a control voltage from the voltage across the capacitive load; and control means that is operative in dependence upon the voltage across the capacitive load to interrupt the cyclic operation of the inverter circuit, the control means applying the control voltage to the further means in opposition to the feedback voltage for inhibiting response of the further means to the feedback voltage.

12. An inverter circuit for charging a capacitive load, comprising:

(a) DC-input terminals;

(b) an inductance;

(c) switching means connected in series with the inductance across the DC-input terminals;

(d) circuit means for switching the switching means cyclically from an ON state to an OFF state for charging the capacitive load incrementally from fly-back in the inductance, the circuit means comprising:

(i) feedback means for deriving a feedback voltage from the fly-back in the inductance, and (ii) a transistor device for regulating the switching of the switching means between the ON and OFF states, the switching means having the ON state while the transistor device is OFF and the OFF state while the transistor device is ON;

(e) means for deriving a control voltage dependent on the voltage across the capacitive load; and (f) control means that is operative in dependence upon the voltage across the capacitive load to interrupt the cyclic operation of the inverter circuit;

wherein the feedback means applies the feedback voltage to the transistor device for switching the transistor device ON during the fly-back of the cycle, and the control means applies the control voltage to the transistor device in opposition to the feedback voltage for holding the transistor device OFF in counteraction to the feedback voltage.

13. The inverter circuit according to claim 12 wherein the means for deriving the control voltage comprises first and second resistors connected together to form a series-resistance chain with one another, electrical connection means connecting the series-resistance chain in series with the capacitive load across the DC-input terminals, the resistance chain having a connection node intermediate the first and second resistors, and a zener diode connected between the connection node and the transistor device, the zener diode responding to the condition in which voltage across the first resistor exceeds a threshold dependent on the zener breakdown voltage of the zener diode, to hold the transistor device OFF.

14. The inverter circuit according to claim 13 wherein the application of the feedback voltage to the transistor device is via resistance of substantially equal value to the second resistor so that the voltage to which the capacitive load is charged incrementally is substantially independent of the voltage of the DC-supply connected to the input terminals.

15. The inverter circuit according to claim 13 wherein the application of the feedback voltage to the transistor device is via resistance of higher value than the value of the second resistor.

* * * * *